US008419205B1

(12) United States Patent
Schmuckle

(10) Patent No.: US 8,419,205 B1
(45) Date of Patent: Apr. 16, 2013

(54) STEP LIGHT FIXTURE

(75) Inventor: Darrin Schmuckle, Vista, CA (US)

(73) Assignee: Hunter Industries Incorporated, San Marcos, CA (US)

( * ) Notice: Subject to any disclaimer, the term of this patent is extended or adjusted under 35 U.S.C. 154(b) by 408 days.

(21) Appl. No.: 12/791,602

(22) Filed: Jun. 1, 2010

(51) Int. Cl.
*F21S 8/00* (2006.01)

(52) U.S. Cl.
USPC ..... 362/146; 362/145; 362/370; 362/374

(58) Field of Classification Search ..... 362/146, 362/145, 370, 374, 576, 375, 368, 152; 40/565; 52/28, 306
See application file for complete search history.

(56) References Cited

U.S. PATENT DOCUMENTS

| | | | | |
|---|---|---|---|---|
| 4,344,114 | A * | 8/1982 | Denhart | 362/147 |
| 4,612,606 | A | 9/1986 | Roberts | |
| 4,625,266 | A | 11/1986 | Winter | |
| 5,001,611 | A | 3/1991 | Beachy et al. | |
| 5,222,799 | A | 6/1993 | Sears et al. | |
| 5,390,090 | A | 2/1995 | Nau | |
| 5,430,627 | A | 7/1995 | Nagano | |
| 5,730,522 | A | 3/1998 | Wyke et al. | |
| 5,749,643 | A | 5/1998 | Porter et al. | |
| 5,810,468 | A * | 9/1998 | Shimada | 362/146 |
| 5,833,351 | A | 11/1998 | Marsh | |
| 5,943,827 | A | 8/1999 | Okerlund | |
| 6,082,870 | A * | 7/2000 | George | 362/146 |
| 6,213,622 | B1 * | 4/2001 | Shimada et al. | 362/146 |
| 6,779,907 | B2 | 8/2004 | Beadle | |
| 6,796,684 | B1 | 9/2004 | Beadle | |
| 6,976,765 | B2 | 12/2005 | Helenowski | |
| 7,290,904 | B2 | 11/2007 | Miller | |
| 7,524,077 | B2 | 4/2009 | Hartman | |
| 7,661,837 | B1 | 2/2010 | Pever et al. | |
| 7,686,485 | B1 | 3/2010 | Pever et al. | |
| 8,066,398 | B2 | 11/2011 | Hartman | |
| 2006/0277823 | A1 | 12/2006 | Barnett et al. | |

* cited by examiner

*Primary Examiner* — Bao Q Truong
(74) *Attorney, Agent, or Firm* — Eleanor M. Musick; Procopio, Cory, Hargreaves & Savitch LLP

(57) ABSTRACT

A step light fixture includes an enclosure for retaining one or more socket and lamp combinations, a light transmissive lens, a cover for sealing the enclosure, and a mounting plate for attaching the fixture on an underside of a stair tread overhang. In a first embodiment, the cover is attached to the enclosure by a removable hinge at a first end that permits the cover to pivot its second end outward away from the enclosure to provide access to the interior of the enclosure. The second end of the cover includes a latch that mates with a corresponding catch on the side of the enclosure to releasably close the enclosure.

25 Claims, 6 Drawing Sheets

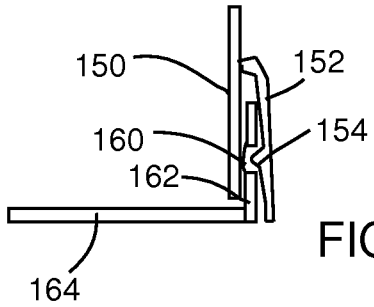
FIG. 13
FIG. 10
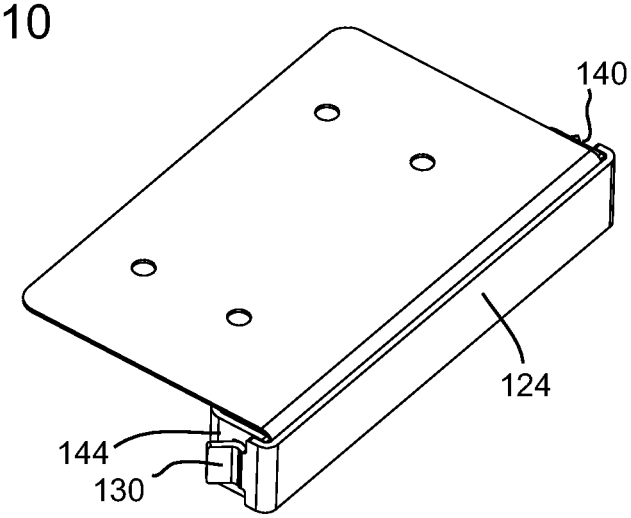

STEP LIGHT FIXTURE

FIELD OF THE INVENTION

The invention relates to a light fixture for illuminating steps and more specifically to a step light fixture that is aesthetically pleasing and easily maintained.

BACKGROUND OF THE INVENTION

Environmental lighting, particularly outdoor lighting, is well known in commercial or public settings such as parks, government buildings, schools and shopping centers. Such lighting is also popular in residential applications, both to enhance the appearance and safety of the outdoor area and for security, to illuminate dark areas around a building or in a yard which may provide hiding places and unobserved entry points for intruders.

One area that can be particularly problematic in both indoor and outdoor settings is stairs, steps and other abrupt changes in surface height, where proper illumination can be the difference between safe passage and injury. Stairs that are insufficiently lit or that are subject to shadows exhibit a safety and security concern, especially outdoors where the light oftentimes cannot be properly directed towards its desired area of use. For example, if the light source is located behind a person as they approach the steps, the person's shadow may make the steps difficult to see. On the other hand, light fixtures physically mounted to the stairs may also impose a danger because stray light or glare emitted from the fixtures may temporarily adversely affect a person's vision. In addition, protruding light fixtures may be subject to inadvertent damage and may even pose a risk of tripping. A common approach to dealing with this challenge is to install recessed fixtures in walls adjacent to the stairs. Examples of such fixtures are disclosed in U.S. Pat. No. 6,796,684 and No. 6,779,907. However, when there are no adjacent walls, or in existing construction where creating the necessary recesses involves significant cutting and drilling into masonry or stucco walls, such fixtures may not be practical.

Another approach to lighting stairs, illustrated in FIG. 1, involves suspending a small lamp enclosure 10 from the edge of a flat plate 8 that is sandwiched between each step riser 4 and the cap stone 6 or other tread surface on top of the riser so that the lamp enclosure is positioned beneath the overhang of the tread, i.e., the "nose" 12 of the stair. This arrangement illuminates both the step riser and the step immediately below so that the edge of each step is illuminated whether one is walking up or down the stairway. Lighting systems of this nature are particularly useful in environments where the lighting level is low, such as in theaters and the like, where it is preferable to have minimal illumination directed upward. For existing construction where the stair tread is already attached to the riser, the plate 8 can be narrow and elongated for attachment solely on the underside of the nose.

The lamp enclosure of step lights typically includes a protective lens that is directed outward or downward from the underside of the stair nose. A closed fixture is particularly appropriate for installations in an outdoor setting, to make the fixtures substantially water-tight and resistant to contaminants, but also provides the fixture with a clean, finished appearance. Maintenance of the fixtures includes cleaning of the lenses and replacement of damaged or burned-out bulbs. Many step lights have a pair of screws, one on either end of the elongated cover that includes the lens, which must be removed in order to access the lamp(s) and lamp socket(s). Obtaining access for removal of the cover can often be awkward, requiring the person performing the maintenance to kneel on a lower stair with their head level with the target fixture in order to locate the screws. Even if the screws are neatly countersunk into the outer surface of the cover face, the exposed screws can ultimately become unsightly after repeated removals since the heads can become scratched and rusty. Avoiding this problem and providing a continuous, aesthetically-pleasing surface involves concealing the screws, possibly on the sides of the fixture housing, however, access to such screws can be particularly difficult in narrow passages where the sides are not easily visible. The screws may also be located on the face of the lens where the screw is accessed from underneath the fixture in a position that cannot be seen and is difficult to access. The small screws can also be easily dropped when trying to remove or replace them.

In view of the foregoing, the need remains for a step light fixture that is attractive and effective as well as easy to install and service.

SUMMARY OF THE INVENTION

It is an advantage of the present invention to provide a step light fixture that is aesthetically pleasing and easily maintained.

In an exemplary embodiment, a step light fixture includes an enclosure for retaining one or more socket and lamp combinations, a light transmissive lens, a cover for sealing the enclosure, and a mounting plate for attaching the fixture on an underside of a stair tread overhang. In a first embodiment, the cover is attached to the enclosure by a removable hinge at a first end that permits the cover to pivot its second end outward away from the enclosure to provide access to the interior of the enclosure. The second end of the cover includes a latch that mates with a corresponding catch on the side of the enclosure to releasably close the enclosure. The latch may be a tab that inserts into a slot, but preferably includes a spring locking clip that cams into a slot or over a ridge when pressed into a closed position. The cover remains closed until the spring clip is pulled outward away from the catch or a sufficient pulling force is applied to the cover to overcome the spring bias. An optional bore may be included in the latch for insertion of a locking screw to protect against vandalism or unauthorized opening of the enclosure.

In one aspect of the invention, a step light fixture comprises a support plate having means for attachment to a bottom surface of a stair tread, a frame extending from a bottom surface of the support plate with a first end and a second end so that the frame defines a back, a first side and a second side of a partial enclosure. A lamp and a lamp socket are enclosed within the partial enclosure with a lens disposed below the lamp socket and lamp. Lens supports extend from the bottom surface of the support plate. A front cover has a first end and a second end, each of the first end and the second end having a retainer that removably attaches the front cover to the first end and the second end of the frame. In a first embodiment, a different retainer is used for each end of the cover. The first end retainer is a removable hinge comprising a bent tab that inserts into a slot in the first end of the frame. The second end retainer is a spring clip that cams into a recess or slot, or over a ridge, formed in the second end of the frame.

In a second embodiment, the same type of retainer, a spring clip, is formed on both ends of the cover to snap into corresponding slots or recesses in the sides of the enclosure. This allows the cover to be removed completely for maintenance. Optional bores may be provided at each end to prevent unauthorized opening of the fixture.

Additional embodiments comprise different combinations of retainers. In one embodiment, the first end retainer is a releasable hinge while the second end retainer is a screw, bolt, pin or other removable fastener that is inserted through corresponding openings in the cover and frame end to releasably close the fixture. In another embodiment, the both retainers are removable fasteners that may be inserted through openings in the cover and frame.

BRIEF DESCRIPTION OF THE DRAWINGS

The present invention will be more clearly understood from the following detailed description of the preferred embodiments of the invention and from the attached drawings, in which:

FIG. 10 is a perspective view of a second embodiment of the step light fixture with two spring clip retainers for attachment of the cover.

FIG. 13 illustrates an alternative arrangement of the latch-type retainer.

DETAILED DESCRIPTION OF THE PREFERRED EMBODIMENTS

Figure 1:
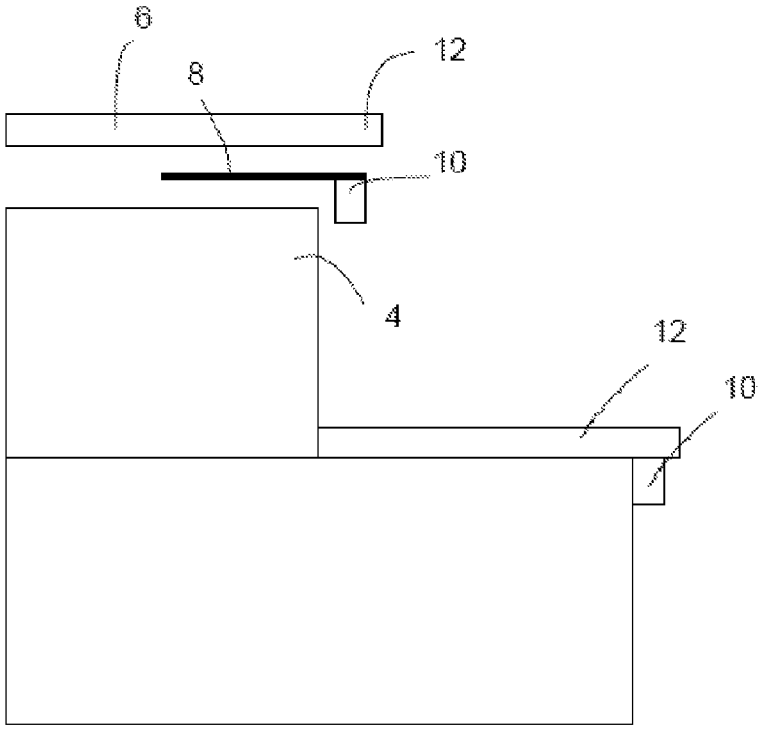
FIG. 1 (PRIOR ART)
FIG. 1 is a partially exploded side elevation of stairs with prior art step light fixtures.
Figure 2:
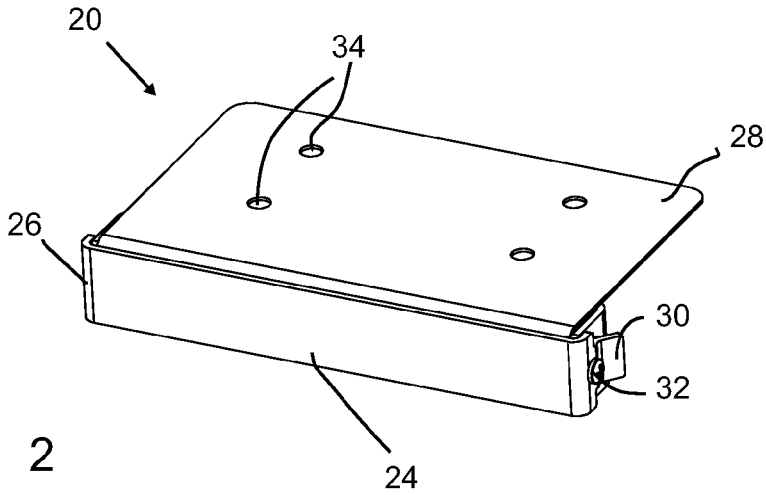
FIG. 2 is a perspective view of a first embodiment of a step light fixture according to the present invention.
Figure 3:
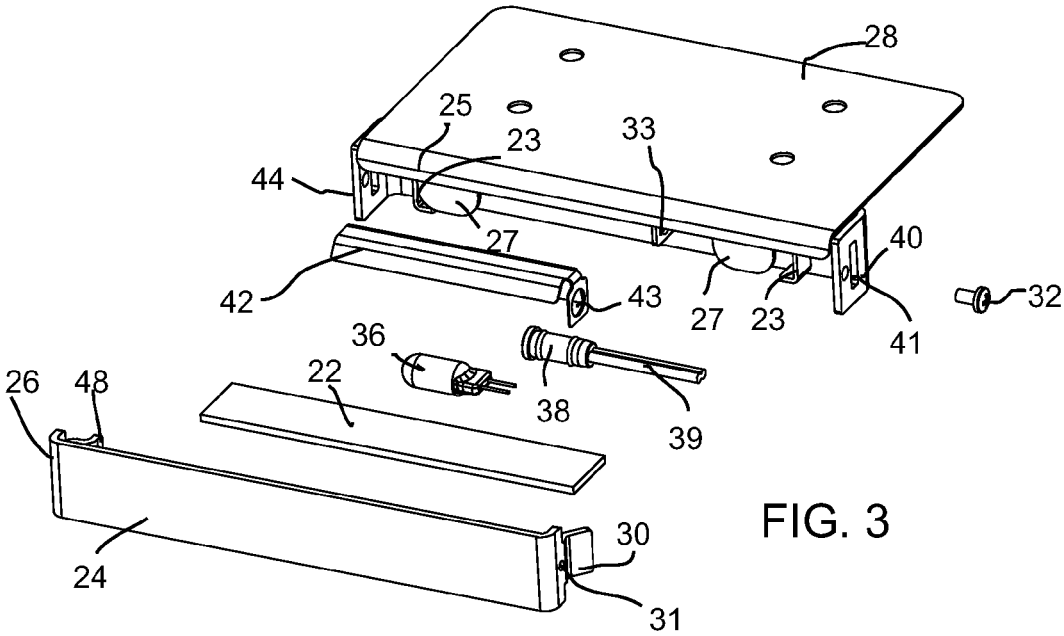
FIG. 3 is a partially exploded perspective view of the embodiment of FIG. 2.
Figure 4:
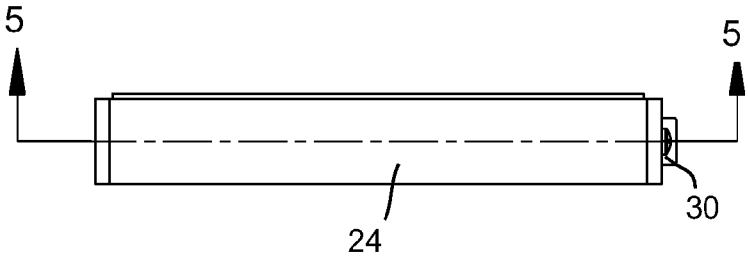
FIG. 4 is a front elevation of the embodiment of FIG. 2
Figure 5:
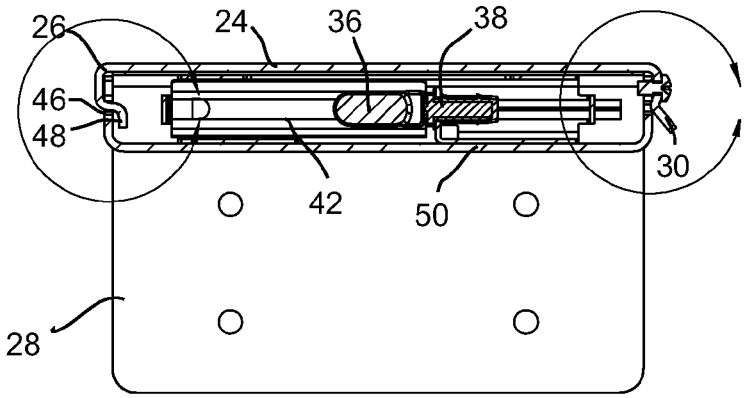
FIG. 5 is a cross-sectional view taken along line 5-5 of FIG. 4.
Figure 6:
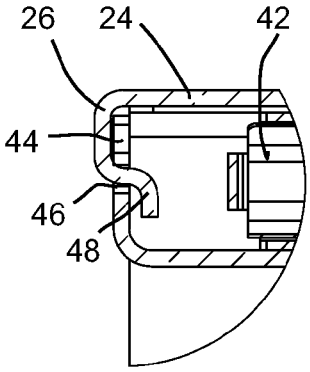
FIG. 6 is a detail view of the hinged end of a cover.
Figure 7:
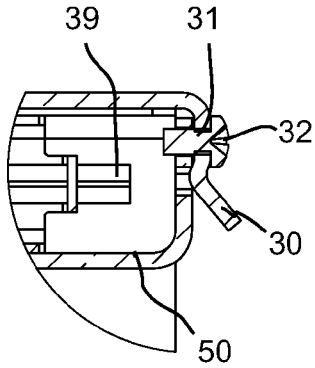
FIG. 7 is a detail view of the spring clip of a cover.

FIGS. 2-8 illustrate a first embodiment of the step light fixture according to the present invention. For purposes of this description, reference to a "stair tread" will include any surface in a structure having a general configuration of a stair tread including a partial overhang under which a light fixture may be attached. In this exemplary embodiment, the mounting plate 28 may be attached to the bottom of a stair tread using fasteners inserted through openings 34 so that the mounting plate 28 is sandwiched between the bottom surface of the stair tread and the upper portion of the stair riser. Where the stair tread is a material that does not easily accept a fastener, such as stone, the mounting plate 28 can be sandwiched in a mortar or other adhesive between the upper portion of the stair riser and the stair tread without the use of other fasteners.

Attached to and extending downward from the bottom surface of mounting plate 28 is a lamp enclosure formed from the combination of frame 50, lens 22 and front cover 24. A lip 25 may be formed in the front edge of the mounting plate. Frame 50, which is fixedly attached to mounting plate 28, defines the back and sides of the enclosure, as well as providing support for the reflector 42, lamp socket 38 and lamp 36. Lens support tabs 27 provide an upper confinement of lens 22, while two L-shaped brackets 23 extend downward from the bottom surface of mounting plate 28 to provide a lower support for lens 22, which sits below the lamp and socket and reflector so that light is projected downward. Reflector 42 is positioned above the lamp and socket to direct light downward. Reflector 42 is held in position between one of the brackets 23 and bracket 33, while the socket 38 is held in place by the opening 43 in reflector 42, which extends downward from the bottom surface of the mounting plate 28. Wires 39, which pass through an opening in each of reflector end 43 and bracket 33, provide electrical connection to a wire or cable (not shown) and a power source. A typical power source will be a transformer that is commonly used with low-voltage outdoor lighting systems, but may also be other sources such as a 120 VAC outlet or a battery, that may, for example, be connected to a solar photovoltaic panel. Sufficient slack should be provided in the wires 39 to allow the socket and lamp to be pulled a short distance from the fixture without risking damage to the wires.

Frame 50 has side portions 40 and 44 which are perpendicular to the back wall to define enclosure sides that support the front cover 24. Frame 50 may be formed from a metal, such as steel or steel alloys, aluminum, stainless steel, brass, copper, or other metals that are commonly used in the manufacture of lighting fixtures. A steel or steel alloy or aluminum may be powder coated for protect against corrosion and provide an aesthetically pleasing appearance. Front cover 24 may be made from any of the metals used for the frame 50, but preferably will have an attractive finish, such as powder coating or anodization, or a metal such as brass or copper, which may be coated to maintain the metal's shine or may be allowed to oxidize or patina. Alternatively, the frame and front cover may be formed from an impact resistant plastic or polymer.

The following description may refer to a first or right side and a second or left side to correspond to the fixture as illustrated in the drawings. It will be readily apparent that the inventive fixture is not limited to the relative positions of left and right and that the right and left components may be reversed. Thus, reference to a left or right side in the following description is for ease of illustration and is not intended to be limiting.

Figure 8:
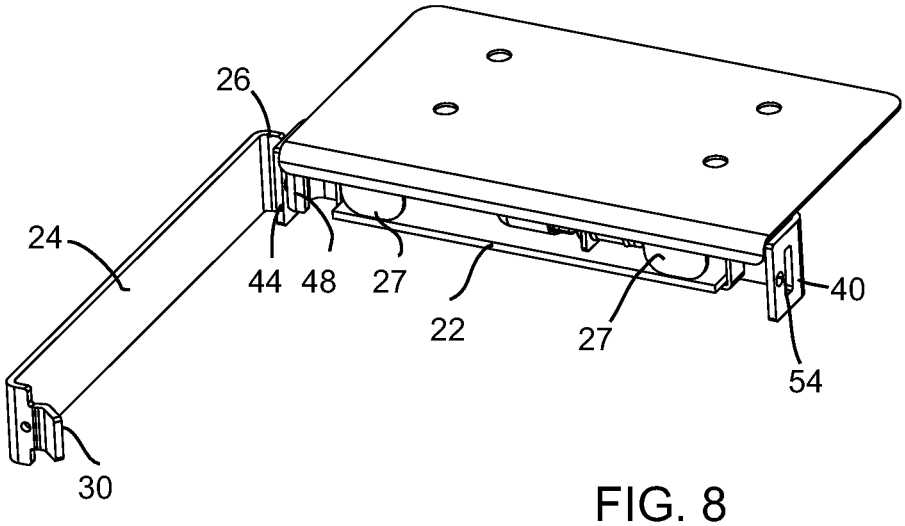
FIG. 8 is a perspective view of the embodiment of FIG. 2 with the cover open.
Figure 9:
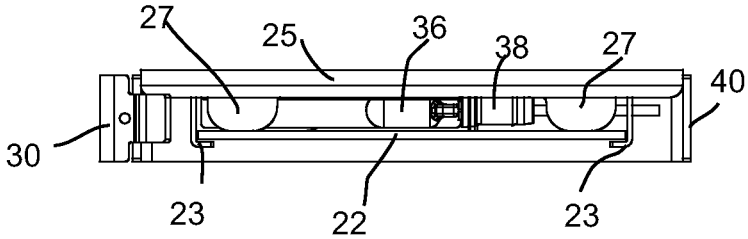
FIG. 9 is a front elevation of the embodiment of FIG. 2 with the cover open.

The left side portion 44 has a slot 46 formed therein for mating with a curved hinge tab 48 that is formed at the left end 26 of front cover 24. The curvature of tab 48 allows the tab to function as a hinge when inserted into slot 46, so that the right end of cover 24 can be swung outward away from the frame 50. The combination of tab 48 and slot 46 defines a first type of retainer that releasably attaches the cover to the frame. Because there is no fixed attachment means such as a hinge pin, the cover 24 can be completely removed by pulling tab 48 out of slot 46. The hinge function of tab 48 is illustrated in FIG. 8, which shows the fixture with the front cover 24 pivoted outward in an open position, with tab 48 shown extending through the opening in side portion 44. An alternative arrangement of the hinge would reverse the relative locations of the tab and slot, so that the slot is formed in the end of the front cover and the curved tab extends outward from the side of the frame to define a pivot point for the cover.

At the right end portion of the cover 24, a latch is formed so that it mates with a corresponding catch on the side of the enclosure to define a second type of retainer for releasably closing the enclosure. The latch may be a tab that inserts into a slot, but preferably includes a spring locking clip 30 that has a ridge portion that cams into a recess or slot 41 in frame side portion 40 when pressed into a closed position. Alternatively, the ridge portion of the spring locking clip can be captured behind a corresponding ridge formed on the frame side portion once the ridge portion of the clip cams over the ridge on the frame. The cover 24 remains closed until the spring clip 30 is pulled outward away from the catch 41 or a sufficient pulling force is applied to the cover to overcome the spring bias. Optional bores 31 and 54 may be included in the latch 30 and side portion 40, respectively, for insertion of a conventional removable fastener 32, for example, a locking screw, pin or bolt to protect against vandalism or unauthorized opening of the enclosure. In an alternate arrangement of the latch-type retainer, illustrated in FIG. 13, a spring clip 152 with ridge 154 may be attached to the second side 150 of the frame so that it extends forward to cooperate with a ridge or slot 160 formed in an extension 162 on the end of the front cover 164. In this configuration, the leading edge of extension 162 will cam the spring clip 152 outward until the ridge 154 on the spring clip snaps into slot 160 in the extension to releasably lock the cover in place.

In a second embodiment of the fixture, shown in FIG. 10, the same basic structure as described above is modified so that front cover 124 has a spring locking clip 130 formed at both ends of the cover. Thus, in this embodiment, the same type of retainer is used at both ends of the cover. The spring locking clips 130 mate with corresponding slots or ridges formed in sides 140 and 144 of the frame. For replacement of the lamp, the entire front cover 124 may be pulled away from the frame by pulling one of the clips 130 away from the frame.

Figure 11:
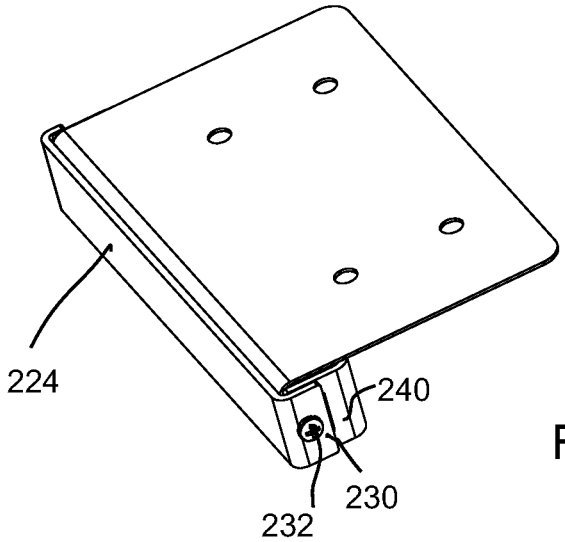
FIG. 11 is a first perspective view of a third embodiment of the step light fixture with a screw fastener as a retainer.
Figure 12:
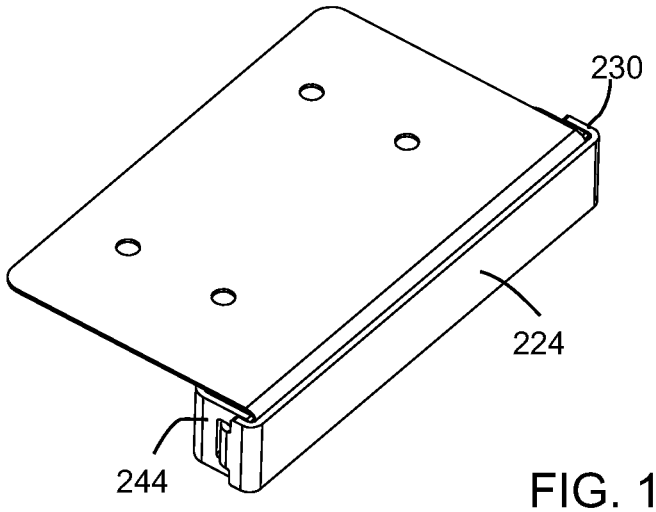
FIG. 12 is a second perspective view of the third embodiment.

A third embodiment of the fixture is illustrated in FIGS. 11 and 12. In this embodiment, the first end 244 of cover 224 has a retainer in the form of a hinge defined by a tab and slot to allow the cover to be swung out away from the frame, as described above with reference to the first embodiment. The second end 230 of the cover is formed without a spring clip, so that the end 230 is a simple lip that is parallel to frame side portion 240. In this embodiment, the retainer is a conventional removable fastener 232 such as a screw, pin, bolt or other similar fastening means that is inserted through end 230 and into side portion 240 to hold the cover in a closed position.

The step light fixture incorporating the attachment means described above is easily maintained while providing an aesthetically pleasing "clean" finish on the visible portion of the fixture.

The foregoing description of preferred embodiments is not intended to be limited to the specific details disclosed herein. Rather, the present invention extends to all functionally equivalent structures, methods and uses as fall within the scope of the appended claims.

What is claimed is:

1. A step light fixture, comprising:

a support plate having means for attachment between a stair riser and a bottom surface of a stair tread;

a frame extending from a bottom surface of the support plate and having a first side and a second side and a back to define a partial enclosure;

a lamp and a lamp socket;

a lens disposed below the lamp socket and lamp;

lens supports extending from the bottom surface of the support plate; and a front cover having a first end and a second end, each of the first end and the second end having a retainer for removably attaching the front cover to the first side and the second side of the frame.

2. The step light fixture of claim 1, wherein the retainer at the first end of the front cover comprises a hinge disposed at the first side of the frame.

3. The step light fixture of claim 2, wherein the hinge comprises a curved tab formed in the first end of the front cover that is releasably inserted through a slot in the first side of the frame.

4. The step light fixture of claim 2, wherein the hinge comprises a curved tab formed in the first side of the frame that is releasably inserted through a slot in the first end of the cover.

5. The step light fixture of claim 2, wherein the retainer at the second end of the front cover comprises a spring clip for mating with a slot or ridge in the second side of the frame to releasably close the front cover.

6. The step light fixture of claim 2, wherein the retainer at the second end of the front cover comprises a slot or ridge for mating with a spring clip attached to the second side of the frame to releasably close the front cover.

7. The step light fixture of claim 2, wherein the second end of the front cover comprises a lip that fits over the second side of the frame, and the retainer at the second end of the front cover comprises a removable fastener insertable through the lip and the second side of the frame for securing the front cover to the frame.

8. The step light fixture of claim 1, wherein the retainer at the first end of the front cover comprises one of a spring clip and a slot or ridge for mating with the other of a slot or ridge and a spring clip in the first side of the frame.

9. The step light fixture of claim 8, wherein the retainer at the second end of the front cover comprises one of a spring clip and a slot or ridge for mating with the other of a slot or ridge and a spring clip in the second side of the frame.

10. The step light fixture of claim 1, further comprising a reflector disposed above the lamp.

11. A step light fixture, comprising:

an enclosure extending downward from a bottom surface of a stair tread, the enclosure comprising a frame having a back, a first side and a second side;

a lamp and a lamp socket retained within the enclosure;

a lens disposed below the lamp socket and lamp to define a bottom of the enclosure; and a front cover having a first end and a second end, each of the first end and the second end having a retainer for removably attaching the front cover to the first side and the second side of the frame.

12. The step light fixture of claim 11, wherein the retainer at the first end of the front cover comprises a hinge disposed at the first side of the frame.

13. The step light fixture of claim 12, wherein the hinge comprises a curved tab formed in the first end of the front cover that is releasably inserted through a slot in the first side of the frame.

14. The step light fixture of claim 12, wherein the hinge comprises a curved tab formed in the first side of the frame that is releasably inserted through a slot in the first end of the cover.

15. The step light fixture of claim 12, wherein the retainer at the second end of the front cover comprises a spring clip for mating with a slot or ridge in the second end of the frame to releasably close the front cover.

16. The step light fixture of claim 12, wherein the retainer at the second end of the front cover comprises a slot or ridge for mating with a spring clip attached to the second end of the frame to releasably close the front cover.

17. The step light fixture of claim 12, wherein the second end of the front cover comprises a lip that fits over the second end of the frame, and the retainer at the second end of the front cover comprises a removable fastener insertable through the lip and the second end of the frame for securing the front cover to the frame.

18. The step light fixture of claim 11, wherein the retainer at the first end of the front cover comprises one of a spring clip and a slot or ridge for mating with the other of a slot or ridge and a spring clip in the first end of the frame.

19. The step light fixture of claim 18, wherein the retainer at the second end of the front cover comprises one of a spring clip and a slot or ridge for mating with the other of a slot or ridge and a spring clip in the second side of the frame.

20. The step light fixture of claim 11, further comprising a curved reflector disposed above the lamp.

21. The step light fixture of claim 11, further comprising a mounting plate attached to a top portion of the enclosure for attaching the enclosure to the bottom surface of the stair tread.

22. A step light fixture, comprising:

an enclosure extending downward from a bottom surface of a stair tread, the enclosure comprising a frame having a back, a first side and a second side to define a partial enclosure;

a lamp and a lamp socket retained within the enclosure;

a lens disposed below the lamp socket and lamp to define a bottom of the enclosure; and a front cover having a first end and a second end, the first end having a hinge and the second end having a retainer for latching the front cover to the second side of the frame.

23. The step light fixture of claim 22, wherein the hinge comprises a curved tab formed in the first end of the front cover that is releasably inserted through a slot in the first side of the frame.

24. The step light fixture of claim 22, wherein the hinge comprises a curved tab formed in the first side of the frame that is releasably inserted through a slot in the first end of the cover.

25. The step light fixture of claim 22, wherein the retainer at the second end of the front cover comprises one of a spring clip and a slot or ridge for mating with the other of a slot or ridge and a spring clip in the first side of the frame.

* * * * *